United States Patent [19]

Pierce

[11] 4,295,665

[45] Oct. 20, 1981

[54] WELL CASING SUSPENSION SYSTEM

[75] Inventor: Elwood K. Pierce, Coldspring, Tex.

[73] Assignee: Petroleum Designers, Inc., Houston, Tex.

[21] Appl. No.: 72,068

[22] Filed: Sep. 4, 1979

[51] Int. Cl.[3] ..... F16L 35/00

[52] U.S. Cl. ..... 285/3; 285/18; 285/141

[58] Field of Search ..... 285/3, 4, 133 R, 141, 285/142, 18, 143, 140, 321, 308, 313, 145; 166/208, 217

[56] References Cited

U.S. PATENT DOCUMENTS

| | | | |
|---|---|---|---|
| 3,287,030 | 11/1966 | Crain et al. | 285/133 R X |
| 3,405,763 | 10/1968 | Pitts et al. | 166/208 X |
| 3,420,308 | 1/1969 | Putch | 285/140 X |
| 3,424,477 | 1/1969 | Putch et al. | 285/142 X |
| 3,893,717 | 7/1975 | Nelson | 285/3 |
| 3,918,747 | 11/1975 | Putch | 285/4 |
| 3,972,546 | 8/1976 | Putch | 285/3 X |
| 4,053,023 | 10/1977 | Herd | 166/348 |
| 4,139,059 | 2/1979 | Carmichael | 285/4 X |
| 4,167,970 | 9/1979 | Cowan | 285/141 X |
| 4,181,331 | 1/1980 | Cowan | 285/141 |

*Primary Examiner*—Dave W. Arola

*Attorney, Agent, or Firm*—Gunn, Lee & Jackson

[57] ABSTRACT

A pipe suspension system for suspending vertically oriented well casings within other well casings and being adapted particularly for well casing hanger systems especially adapted for underwater installation wherein casing hanger suspension systems may be installed at or near the bottom of the body of water. A releasable locking mechanism is employed which includes a self contracting expandable lock positioning ring that is transported during installation of an inner pipe by a physical interconnection with the inner well casing. The lock positioning ring functions to control a locking ring that transfers the weight of the inner pipe to the outer casing and further functions in a weight supporting capacity to assist the locking ring in supporting the weight of the inner casing. Upon raising of the inner well casing relative to the outer casing, the lock positioning ring retracts within a receptacle provided in the inner casing so as not to interfere with casing removal.

13 Claims, 16 Drawing Figures

36
42
10
40
38
50a
50b
74
138
140
32
134
146
46
44
142
48
126
50
136
130
82
124
97
144
132
94
52
122
58
54
128
96
56
60
120
22
66
70
62
64
68
92
88
12
24
90
28
20
86
16
26
84
18
30
121
14
76
78
80
36
34

WELL CASING SUSPENSION SYSTEM

FIELD OF THE INVENTION

This invention relates generally to suspension systems for suspending well casings within wells and, more particularly, relates to a well casing hanger or suspension system incorporating a locking ring system that establishes a supporting interconnection between inner and outer pipe members to support inner pipes or well casing within outer pipes or casing. Even more specifically, the present invention is directed to a well hanger or casing suspension system incorporating a locking ring that transfers the weight of the inner casing to the outer casing and further includes a lock positioning ring that functions to position the locking ring and also provides a supporting function that assists the locking ring in transferring the weight of the inner pipe to the outer pipe.

BACKGROUND OF THE INVENTION

In the past, it was the general practice to complete oil and gas wells by providing a casing hanger system that is provided at or near the surface of the earth. Many land wells are still completed in this manner with excellent success. With the advent of offshore drilling in order to produce petroleum products from production zones located beneath bodies of water, it has become desirable to provide well casing hanger systems that are adapted to be positioned at or near the bottom of the body of water. With the development of the hanger systems of U.S. Pat. Nos. 3,287,030 and 3,405,763, and other U.S. patents, it has become practical to provide well completion systems, typically known as "mud line suspension systems," that enable the location of well casing suspension systems at or near the bottom of bodies of water. Moreover, thse mud line suspension systems also enable the driller to pull away from the well being drilled when circumstances necessitate doing so and subsequently reestablish a well drilling connection with the subsea well casing suspension system when it is desirable to continue drilling operations. By locating well suspension systems at or near the ocean floor, a temporarily abandoned well or capped well does not present an obstruction that typically interferes with the marine environment. Such suspension systems also enable the driller to complete wells by means of an ocean floor completion or extend the conduits to the surface for completion on platforms and consequently lends a degree of flexibility in completion systems that renders such hanger systems desirable.

As is evident from U.S. Pat. No. 3,287,030, subsea suspension systems are also effectively provided with wash ports that enable casing cement to be washed from the hanger system in order that the casing cement does not interfere with subsequent connection and disconnection of well completion conduits to the casing hanger assembly.

In order to establish a locked interconnection between the hanger system and inner casing that is supported by the hanger, U.S. Pat. Nos. 3,420,308; 3,424,477; 3,893,717; and 3,972,546 incorporate weight energized locking mechanisms that establish a weight supporting function to transfer the load of inner supported casing to outer supporting casing. Further, these patents disclose shearable elements that assist in controlling activation of the locking mechanisms and, in some cases, as in U.S. Pat. No. 3,420,308, also function to provide a weight supporting function for the locking mechanism. Other patents of interest to well hanger systems for underwater completion include U.S. Pat. Nos. 3,287,030 and 3,405,763. A more recent development in undewater well completion systems is exemplified by U.S. Pat. No. 4,053,023. It is a feature of the present invention to provide a novel casing hanger suspension system for completion of wells, such as underwater wells, wherein a locking mechanism is employed in the casing hanger automatically releasable and weight energized locking system for establishing interconnection between inner and outer casings of the casing hanger system.

It is also a feature of the present invention to provide a novel casing hanger system wherein an expandable locking ring is employed to establish an interconnection between inner and outer casings and the weight of the inner casing is supported by the locking ring and by a lock positioning ring that is also weight energized to expand radially into supporting relation with the wall surface of the outer casing.

It is also a feature of this invention to provide a novel locking mechanism for well casing hanger assemblies wherein a lock positioning ring is employed that is capable of automatically retracting to a noninterfering position in the event the inner pipe is moved upwardly for removal from the outer pipe of the casing hanger system.

Still a further feature of this invention concerns the provision of a novel locking mechanism for well casing hanger assemblies and which is transported along with the inner pipe being inserted into an outer pipe of the casing hanger assembly by means of a shearable or mechanically interconnected relation with the inner pipe structure.

Other and further objects, advantages and features of this invention will become obvious to one skilled in the art upon an understanding of the illustrative embodiment about to be described and various advantages, not referred to herein, will occur to one skilled in the art upon employment of the invention in practice.

SUMMARY OF THE INVENTION

In accordance with the present invention, a well casing suspension system is provided for suspending vertically oriented casings within other casings and which suspension system is adapted particularly for well casing hanger systems, especially for underwater installation at or near the bottom of a body of water such as lakes, oceans, etc. The casing suspension system is adapted particularly as a well casing hanger system that enables the support of various internal casings of a well system within an outer well casing. For the establishment of a locked interconnection between an outer well casing and an inner casing of the well casing hanger system, a locking ring is employed having the capability of expanding into locked and weight supporting engagement relative to a locking recess that is defined within the outer casing. A locking element of the locking ring is receivable within the locking recess and provides an annular shoulder that is seated against an upwardly directed supporting shoulder of the outer casing, thus adequately transferring the weight of the inner pipe to the outer casing. The locking ring, which also includes key portions that are receivable within key recesses of the outer casing is automatically expandable radially outwardly when the key portions of the hanger ring become registered with the key recesses of the outer casing during installation. The locking ring is in the form of a split ring of fluted configuration and which is forcibly contracted into a receiving recess during running or installation by engagement with the inner surface of the casing through which it is moved. When the locking ring becomes registered with the key recess and locking recess of the outer pipe, the locking ring expands radially by virtue of its springlike nature, thereby inserting the key portions and locking portions thereof into respective recesses within the outer casing. Subsequent to expansion of the locking ring into the locking recess and key recess of the outer casing, the inner casing is allowed to move downwardly a sufficient distance to position a circular positioning portion of the inner casing inside of the locking ring in the vicinity of the locking portion thereof, thereby preventing subsequent contraction of the locking ring and ensuring maintenance of an adequate supporting and locking engagement of the locking portion of the locking ring within the locking recess.

A locking ring positioning element is supported by a structural interconnection with the inner pipe during running or installation and ensures proper positioning of the locking ring as the locking ring is moved through the outer pipe and into registering position with the locking and key recesses of the outer pipe. Upon downward movement of the inner pipe relative to the outer pipe and locking ring, the locking ring positioning element is restrained by the locking ring and a tapered annular surface of the inner casing hanger body moves into engagement with a mating tapered portion of the locking ring positioning element. The locking ring positioning element is a split ring which is urged radially inwardly by the inherent spring-like nature thereof and is cammed radially outwardly by the tapered surface of the inner casing hanger body causing annular serrations formed at the outer periphery thereof to establish a load supporting engagement with the inner wall of the outer casing or casing suspension collar. Thus, the locking ring positioning element also provides a load supporting function between the inner and outer pipes, which enhances the load supporting capability of the locking jing of the well casing hanger system.

Physical interconnection of the locking ring positioning element relative to the inner casing may be by means of a plurality of shear pins or by means of interrelated serrations or threads that cause the locking ring positioning element to be retained in position during running and automatically released from its connection with the inner pipe during seating of the inner pipe relative to the outer pipe by means of the locking mechanism.

BRIEF DESCRIPTION OF THE DRAWINGS

In order that the manner in which the above-recited advantages and features of this invention are attained and can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of this invention, and therefore are not to be considered limiting of its scope, for the invention may admit to other equally effective embodiments.

In the drawings.

DETAILED DESCRIPTION OF PREFERRED EMBODIMENT

Figure 1:
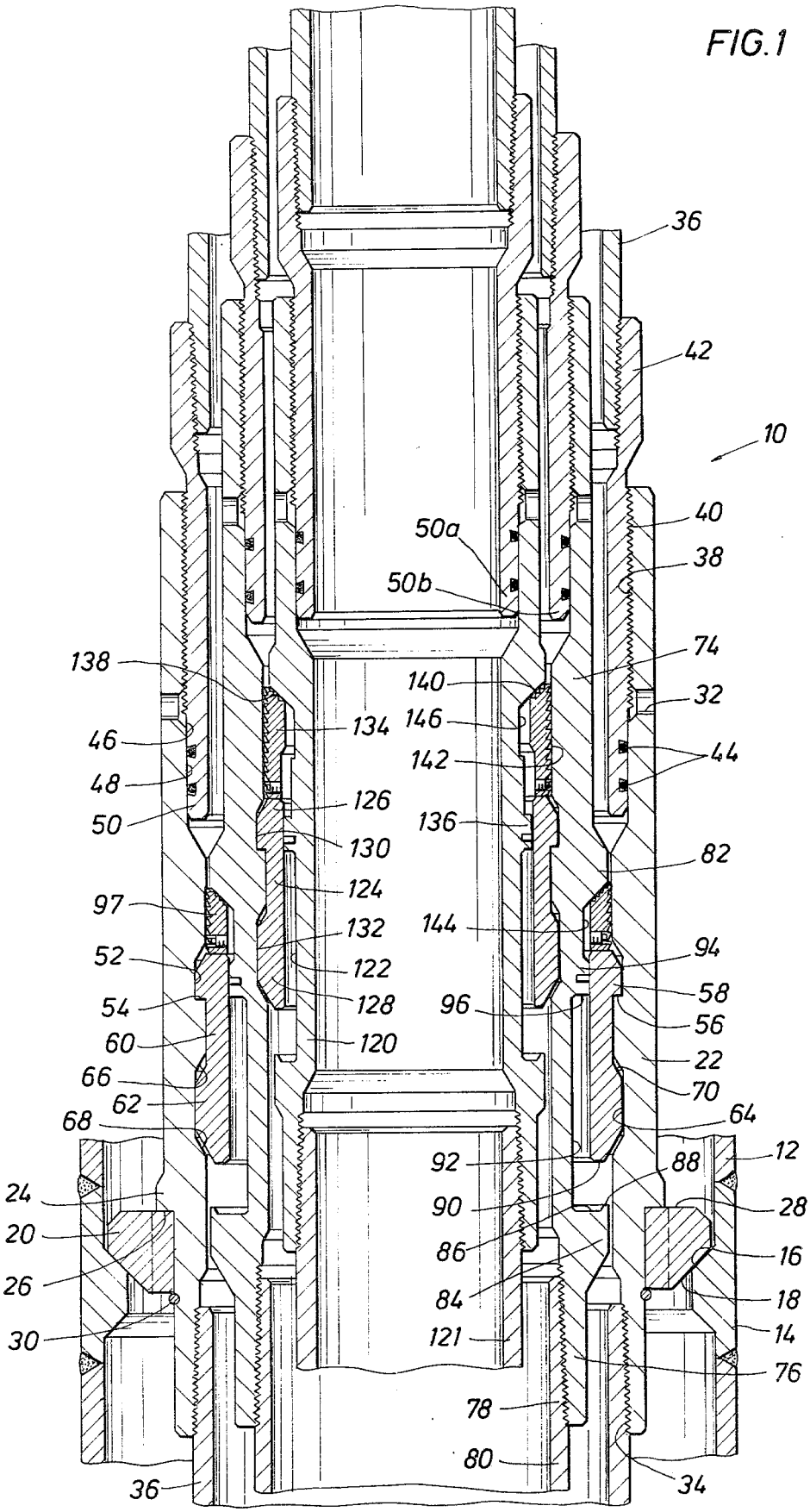
FIG. 1 is a sectional view of a well casing hanger assembly which is constructed in accordance with the present invention and is depicted in the set or landed position thereof with locking interconnection being established between the inner and outer pipes by locking rings and locking ring positioning elements functioning in coordinated manner.

Referring now to the drawings and first to FIG. 1, a well casing suspension system is illustrated generally at 10 and is adapted particularly for installation near the bottom or mud line of bodies of water such as in a subsea environment. In the drilling of wells for production of petroleum products, a large outer casing 12, such as a casing having a twenty inch outside diameter, is first installed in the sea bed to a suitable depth. Typically, the outer casing is referred to as a conductor pipe and is driven to a conventional depth for drive pipes at the particular region and a hanger seating collar or coupling 14 is interconnected within the casing 12 by means of welding or the like and is formed to define an internally tapered upwardly facing shoulder 16 that defines a seating surface against which is seated a tapered downwardly facing surface 18 of a casing hanger ring 20. Inside of the outer casing or conductor 12 is positioned a casing suspension collar 22 which may be also referred to as a casing head and which is formed to define an annular enlarged portion 24 that defines a circular shoulder 26 that engages the upper surface 28 of the hanger ring 20, thus allowing the weight suspended from the casing suspension collar 22 to be transferred through the hanger ring to the hanger coupling 14 and conductor 12. Positioning of the hanger ring 20 during installation and retraction of the casing suspension collar 22 is maintained by means of a snap ring 30 that is received within an appropriate groove formed in the outer periphery of the casing suspension collar. The upper portion of the casing suspension collar is formed to define a plurality of wash ports 32 while the lower portion of the collar 22 is formed to define an internally threaded lower portion 34 providing threaded support for a casing 36 to which the casing suspension collar 22 is connected. The upper portion of the casing suspension collar 22 is formed to define an elongated, internally threaded portion 38 that is adapted to receive an elongated, externally threaded portion 40 of a hanger sub 42. The sub 42 is adapted to be partially unthreaded from the casing suspension collar during wash-out operations to expose the wash ports and allow circulating wash fluid to remove casing cement from the casing suspension system at the termination of casing cementing operations. At the lower portion of the hanger sub is provided a pair of annular sealing elements such as O-rings 44 that establish sealing engagement with internal surface portions of the casing suspension collar 22 in the manner shown. The upper sealing ring 44 is adapted to establish sealing engagement with a cylindrical porton 46 of the internal surface area of the casing suspension collar 22 while the lower sealing ring 44 establishes engagement with a slightly tapered, upwardly facing portion 48 of the inner surface area of the casing suspension collar. The lower extremity of the hanger sub 42 is formed to define a tapered nose portion 50 that is cammed radially inwardly as the lower portion of the hanger sub is moved downwardly, thus developing a tight metal-to-metal seal as well as utilizing the sealing characteristics of elastomeric sealing members such as O-rings 44 or other annular seals. In each case where additional inner hanger systems and cement wash ports are employed to facilitate efficient removal of uncured cement following cementing operations, such as shown at 50*a* and 50*b*, elastomeric seals and cooperative tapered metal sealing surfaces and yielding nose portions are employed to achieve optimum sealing and thus ensure maintenance of the seal integrity of the casing system involved.

Figure 4:
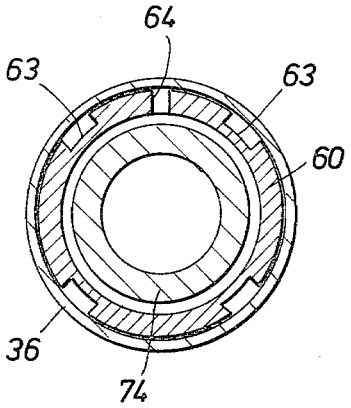
FIG. 4 is a transverse sectional view taken along line 4—4 of FIG. 2 and showing the locking portion of the locking ring and its relation with the inner and outer casing structures during running operations.
Figure 5:
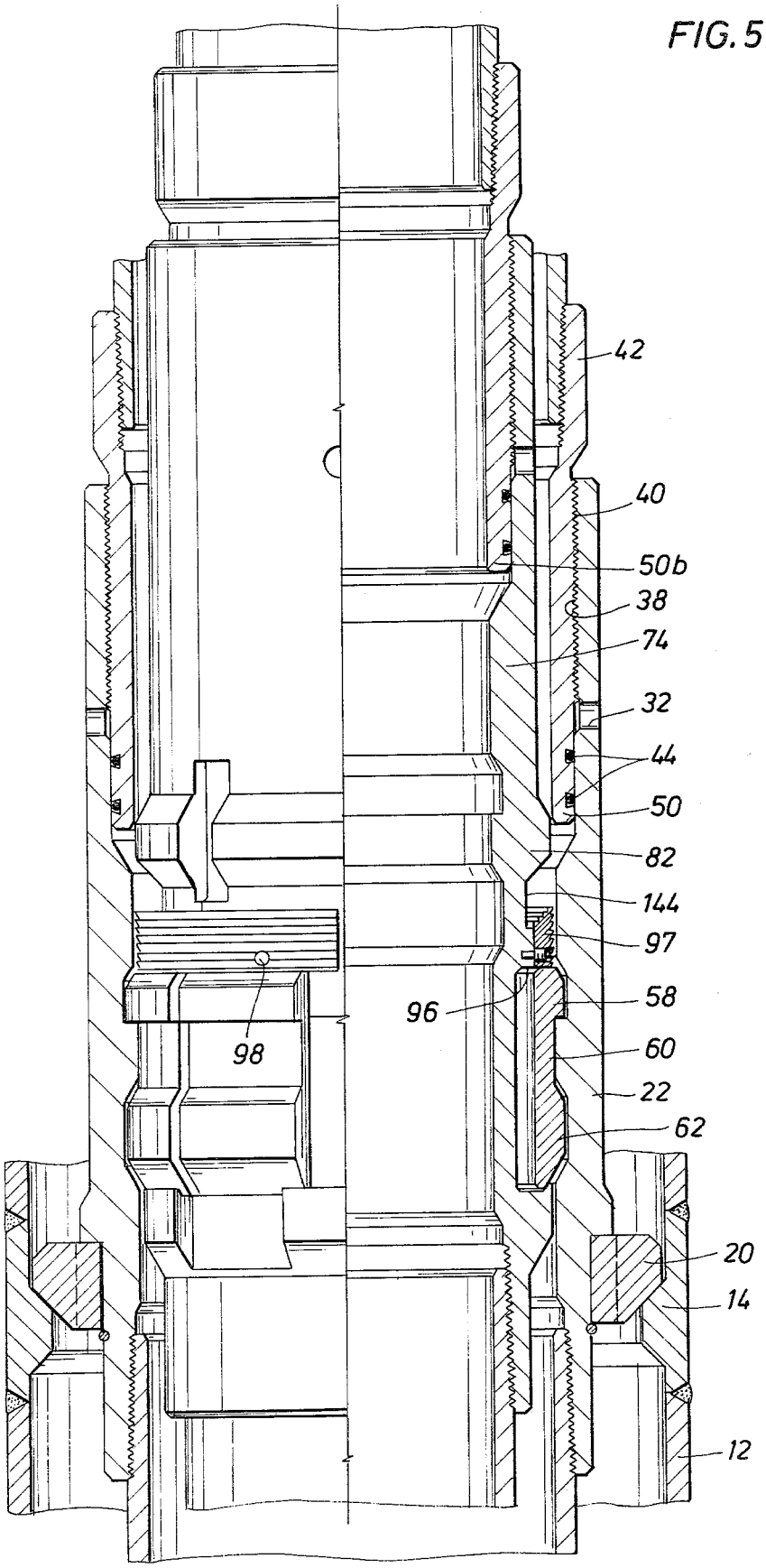
FIG. 5 is a partial sectional view illustrating outer casing and casing hanger structures in section, showing the inner casing hanger structure in quarter section and further illustrating positioning of the locking ring in received or registering relation within locking and key recesses formed within the outer casing structure and with the locking ring positioning element being shown in the running position thereof immediately preceeding shearing of the pins that interconnect the locking ring positioning element with the inner casing structure.
Figure 6:
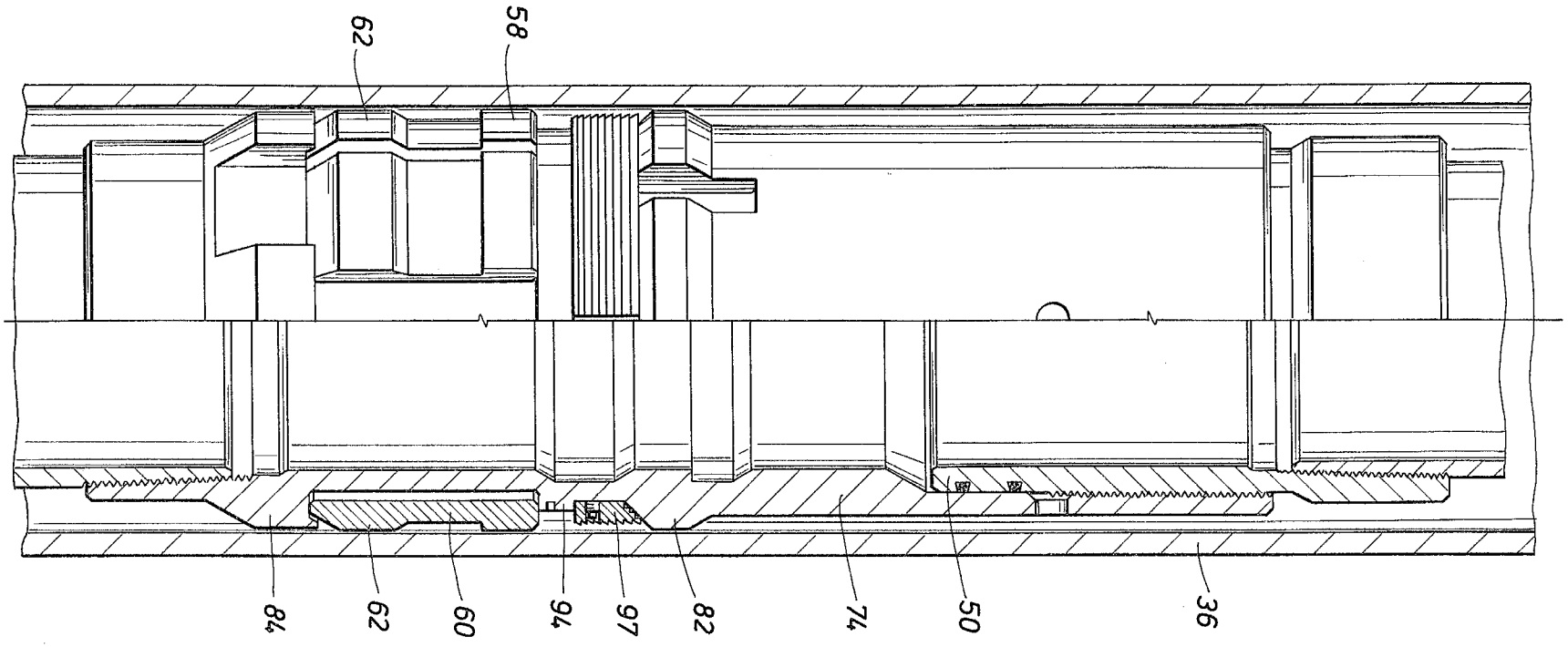
FIG. 6 is a sectional view of the well casing hanger assembly of FIGS. 1–5, illustrating retraction of the inner pipe from the outer pipe subsequent to previous landing operations and illustrating the position of the locking ring and locking ring positioning element during retraction or pullout of the inner casing from the outer casing.

It is desirable to position inner casings within outer casings and to achieve efficient and positively interlocked suspension of the inner casing structure by the outer casing. In accordance with the present invention, such is conveniently accomplished by provision of a casing interlocking system that employs locking elements that are energized by the weight applied thereto by the inner casing structure that is supported by the casing head. As shown in FIG. 1, the casing suspension collar 22 is formed internally to define an annular locking recess 52 forming an annular lock support shoulder 54 that is adapted to be engaged by an annular support shoulder 56 defined by an enlarged upper locking portion 58 of a locking ring 60. As is evident from FIGS. 2 and 4, the locking ring 60 is formed to define a plurality of grooves or flutes 62 and therefore the shoulder surface 56 is actually defined by a plurality of segmented surfaces that define channels to permit circulation of fluid past the suspension system. As further shown in FIG. 4, the locking ring 60 is split as shwon at 64 and therefore is enabled to expand and contract as necessary to permit insertion of the locking portion 58 into the locking recess upon registry thereof. Further, the locking ring 60 is in the form of an annular spring which is forcibly contracted as the inner casing is being run or inserted into the outer casing. During insertion or running of inner casing, the locking ring is forcibly contracted and the outer periphery of the locking ring 60 is in engagement with the inner surface of the casing through which it is passing. Upon reaching the locking recess or receptacle, the split locking ring 60 expands rapidly with a snap action due to its spring nature, fully inserting the locking portion 58 thereof into the receptacle 52 and bringing the surfaces 54 and 56 into full load supporting engagement.

Figure 2:
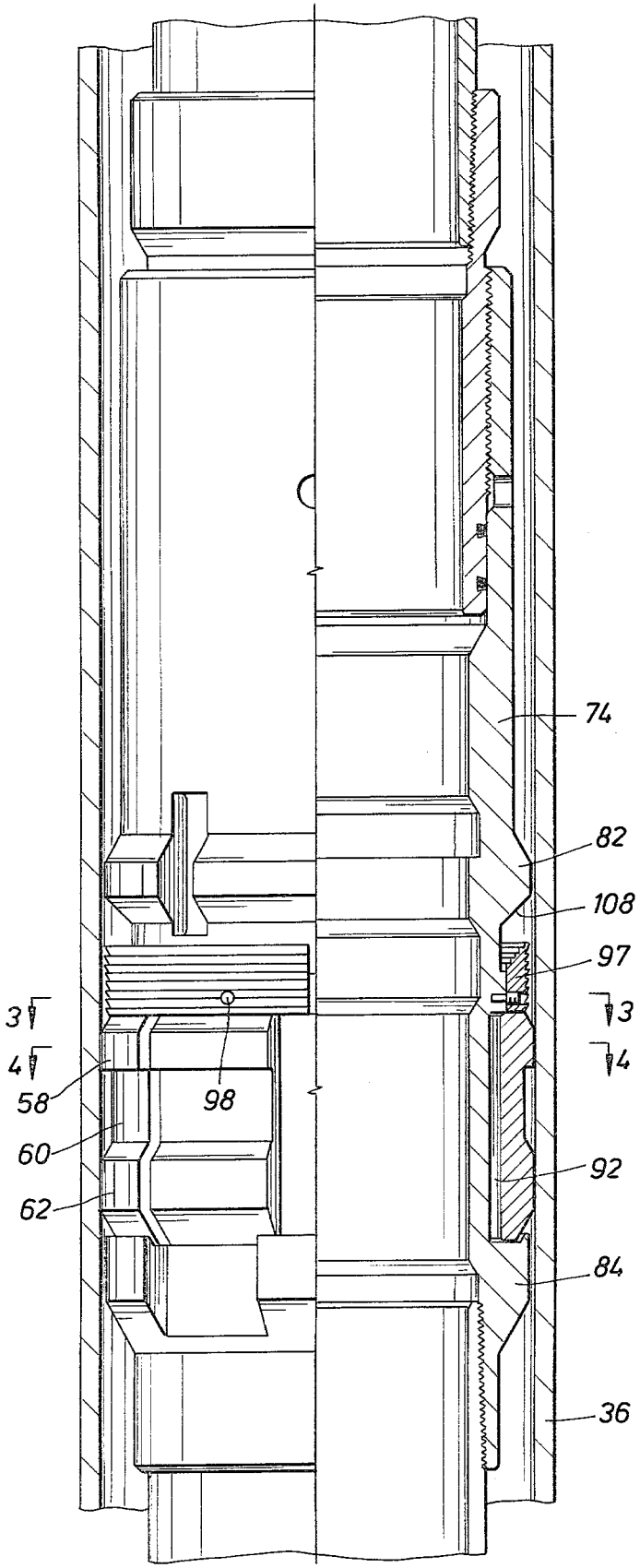
FIG. 2 is a sectional view of the well casing suspension system of the present invention illustrating running or installation of an outer well casing within an inner well casing and with the locking ring and locking ring positioning element being maintained in the retracted or deactivated condition thereof during running.
Figure 3:
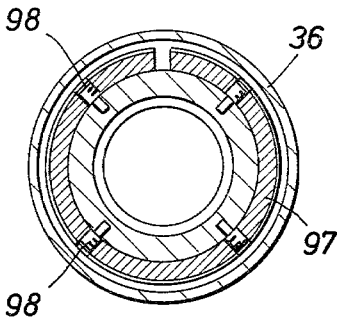
FIG. 3 is a transverse sectional view taken along line 3—3 of FIG. 2 and showing the locking ring positioning element and its relation with the inner and outer casing during the running or installation procedure.
Figure 8:
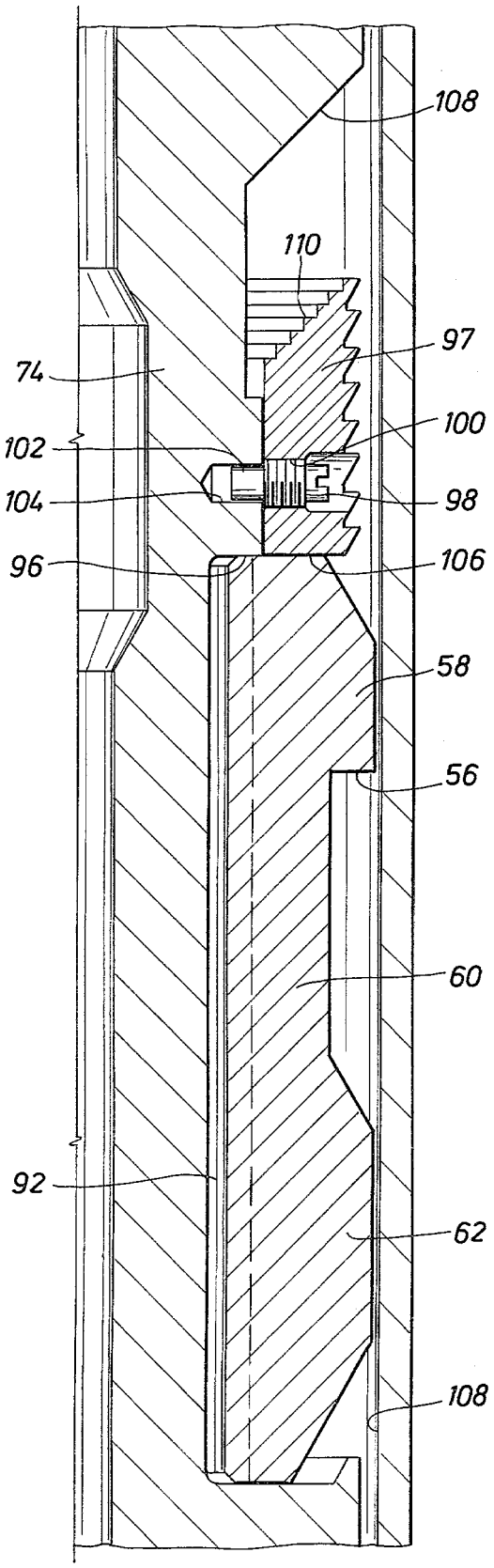
FIG. 8 is a fragmentary sectional view of the well casing suspension system of FIGS. 1–7, illustrating the locking ring and locking ring positioning element in the running or installation condition thereof during initial insertion of an outer well casing into an inner well casing.
Figure 9:
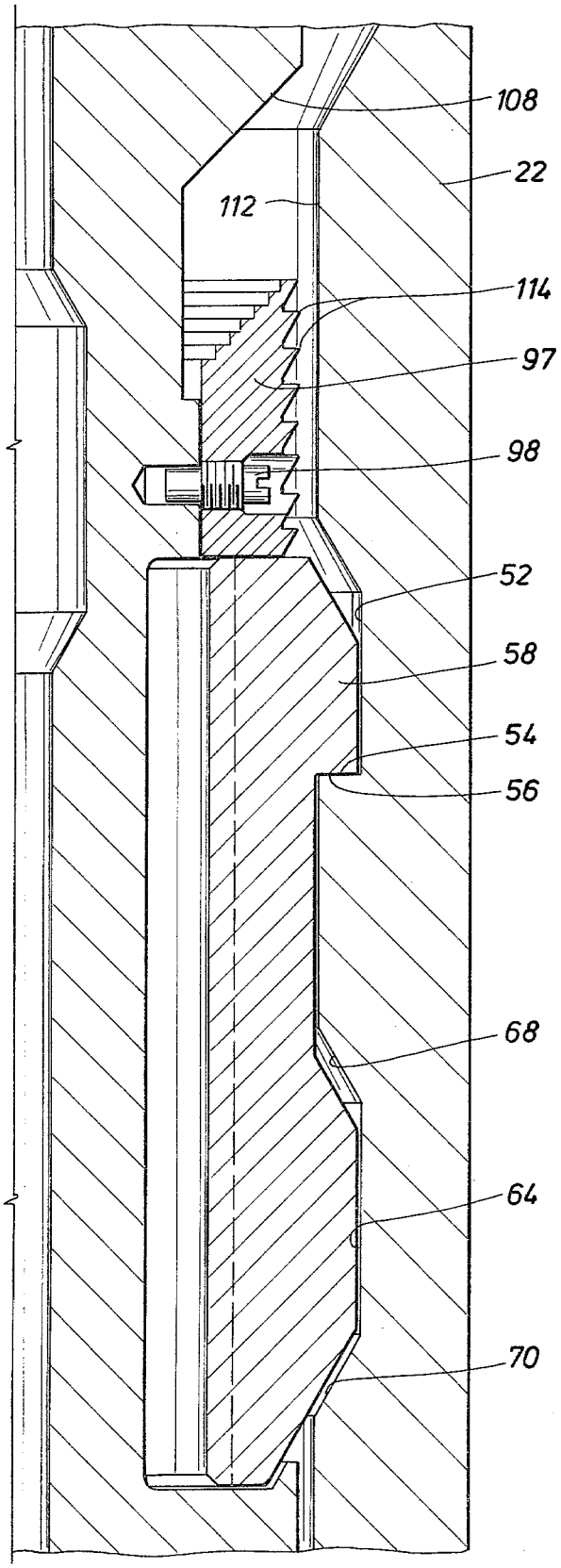
FIG. 9 is a fragmentary sectional view similar to that of FIG. 8 and illustrating the locking ring and locking ring positioning element in the partially landed positions thereof.

The lower portion of the locking ring 60 is formed to define a plurality of fluted key elements 62 that are adapted to be received within an annular key recess 64 defined within the casing suspension collar 22 immediately below the locking recess 52. The key is defined by upper and lower tapered surfaces 66 and 68 that are engageable by mating tapered surfaces 70 and 72 that define upper and lower portions of the key elements 62. The axial length of the key recess 64 is greater than the axial length of the key elements 62 and with shoulders 54 and 56 in intimate engagement, the key elements will be out of contact with either of the tapered surfaces 66 and 68 of the key recess. Under circumstances where the locking ring 60 is moved upwardly relative to the casing suspension collar 22, surfaces 66 and 70 will react in cam-like manner and will cause forcible radial contraction of the locking ring, causing the outer periphery thereof to conform to the inner diameter of the casing through which it is to be moved. This condition will occur during extraction of the inner casing from the outer casing in the manner discussed hereinbelow. An inner casing hanger body also defining a casing suspension collar is provided as shown at 74 having an internally threaded lower extremity 76 that is adapted for threaded engagement with the externally threaded upper portion 78 of an inner casing 80. The inner casing hanger body 74 is formed to define upper and lower external annular enlargements 82 and 84 with the lower enlargement defining a locking ring transporting surface 86 surrounded by an annular rim 88. The locking ring transporting surface 86 is adapted to be engaged by the lower extremity 90 of the locking ring 60 as the inner casing suspension collar 74 is moved upwardly during extraction of the inner casing 80 from outer casing 36. The annular rim 88 ensures proper positioning of the locking ring during transporting thereof by the inner casing suspension collar 74. The upper and lower enlarged portions 82 and 84 of the inner casing suspension collar 74 cooperate to define an annular external recess 92 that is of sufficient dimension to retain the locking ring 60 in the fully contracted condition thereof. Immediately above the receptacle 92 is formed an annular external enlargement 94 that defines a downwardly facing shoulder surface 96 which is adapted for engagement with the upper extremity of locking ring 60. The annular enlargement 94 also provides for structural support of an annular locking ring positioning element 97 such as by shear pins 98 in the manner illustrated in FIGS. 2, 5, 8 and 9. In the running condition when the inner casing is being inserted into the outer casing, the locking ring and locking ring positioning element will be positioned as shown in FIGS. 2 and 8. In this case, a plurality of shear pins 98 are received within internally threaded apertures 100 defined in the locking ring positioning element and shearable projections 102 of each of the shear pins are positioned within blind bores 104 formed in the inner or hanger body or casing suspension collar 74.

Figure 10:
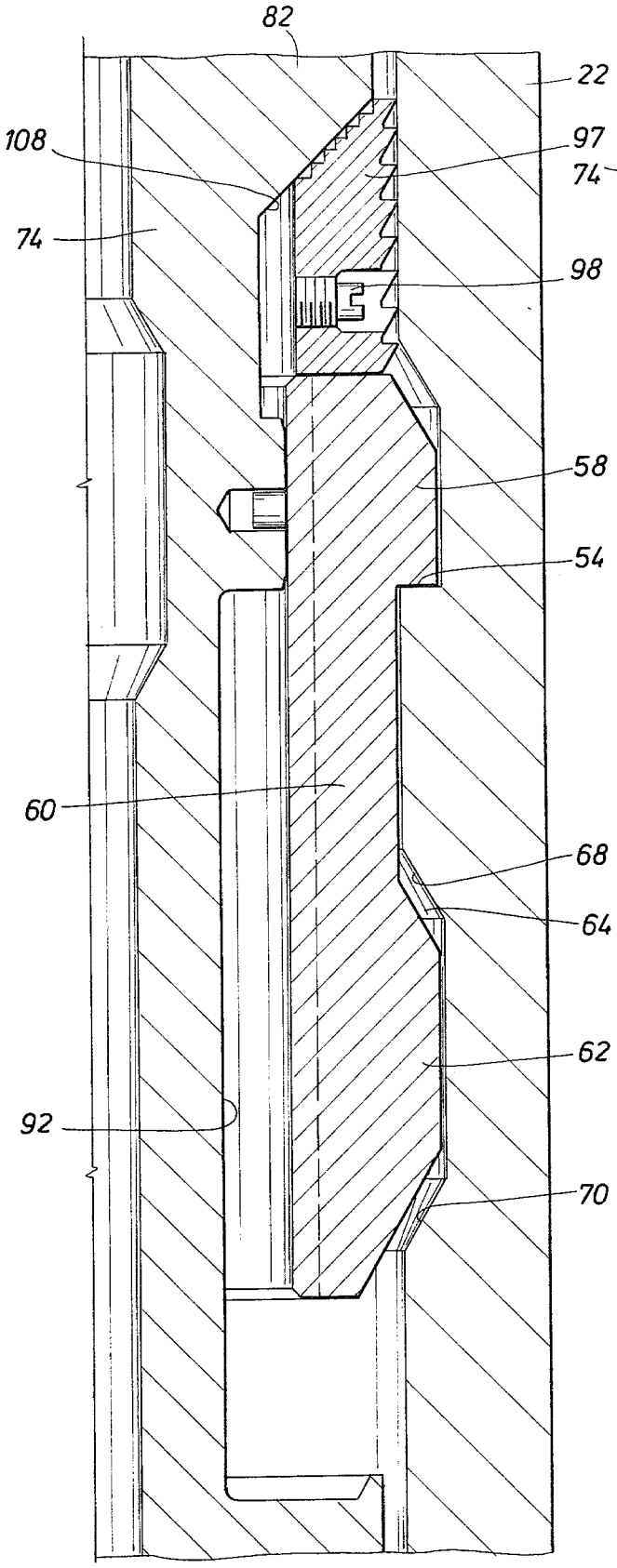
FIG. 10 is a fragmentary sectional view similar to that of FIGS. 8 and 9 and illustrating the locking ring and locking ring positioning element in the fully landed positions thereof.

During running operations, as the inner casing is being inserted into the outer casing, the upper extremity of the locking ring 60 is in engagement with annular shoulder 96 and also in engagement with the lower surface 106 of the locking ring positioning element 97. In this condition, as exemplified in detail in FIG. 8, the outer segmented surfaces of the locking portions 58 and key portions 62 of the locking ring 60 will be in substantial contact with the inner surface 108 of the outer casing 36 at a level above the casing suspension collar 22. After the inner casing has moved downwardly a sufficient distance to bring the locking portion 58 and key portion 62 of the locking ring 60 into registry with the locking recess 52 and key recess 64 the locking ring will immediately expand radially by means of its inherent spring nature and will thus assume the position illustrated in FIGS. 5 and 9. When this occurs, the upper extremity of the locking ring 60 will move out of engagement with annular shoulder 96 and will remain in engagement with the lower surface 106 of the locking ring positioning element 97. This position is referred to as the partially landed position wherein the inner casing has not completed its downward movement, but the locking ring is fully expanded to its properly engaged relation relative to the locking recess and the key recess. As the inner casing continues to move downwardly, the great weight thereof overcomes the structural integrity of the shear pins 98, thus causing shearing of the pins, allowing the inner casing and the inner casing suspension collar 74 to continue downward movement to the position illustrated in FIGS. 7 and 10. The upper annular enlargement 82 of the collar 74 defines a downwardly directed tapered surface 108 that is adapted for engagement with a tapered upper portion 110 of the locking ring positioning element 97. Upper portion 110 of the positioning element 97 is defined by a plurality of annular ridges and grooves with the ridges being slightly deformable as surface 108 is brought into forcible engagement therewith. Since the lock positioning element 97 is in the form of a split ring, a camming activity occurs as surfaces 108 and 110 are brought into forcible engagement, causing the outer peripheral portion of ring element 97 to be forced radially outwardly into seated engagement with the inner cylindrical surface 112 of the outer casing suspension collar 22. This radial expansion is limited, however, by the ridged and grooved tapered portion 110 of the lock positioning element 97 which restricts the development of radial force against surface 112. The outer periphery of the split ring positioning element 97 is defined by a plurality of annular upwardly directed teeth 114 which may be of circular configuration or, in the alternative, may be formed simply by means of threads of suitable cross-sectional configuration. As the outer periphery of split ring element 97 is forced into engagement with surface 112, the downwardly directed force applied by tapered surface 108 react against the tapered upper surface portion 110 of the split ring, thus developing a resultant force that acts downwardly and radially outwardly in the manner shown by the force arrow in FIG. 10. In this manner, a portion of the weight applied from the inner casing suspension hanger 74 is transferred radially outwardly through the expandable split ring 97 into the outer casing suspension collar 22. Simultaneously, the downwardly directed force applied by tapered surface 108 against the locking ring positioning element 97 results in direct transfer of downwardly directed force through the split ring 97 and into the locking ring 60. This force is then transferred through the locking portion 58 of the locking ring to the upwardly directed shoulder surface 54 in the manner described above. Thus, the radially expandable locking ring positioning element 97 functions to assist the locking ring in transfer of downwardly directed force into the outer casing suspension collar 22 and thus greatly enhances the load transfer capability of the casing suspension collar, enabling the casing suspension system to support substantially greater weight as compared to weight supporting capability through the locking elements alone.

As shown in FIG. 1, the well casing suspension system further incorporates another inner casing suspension collar 120 which is threadedly connected to another inner casing 121 and is formed to define a similar external configuration as compared to the casing suspension collar 74, but is of smaller diameter. The casing suspension collar 120 defines an annular recess 122 tha is adapted to receive an expandable and contractable locking element 124 having an upper locking portion 126 and lower key portions 128 that are receivable respectively within locking and key recesses 130 and 132. A locking ring positioning element 134 is capable of being retained in assembly with an annular enlargement 136 of the casing suspension collar 120 by means of shear pins that function in similar manner as described above in connection with shear pins 98. A downwardly directed annular surface 138 of the casing suspension collar 120 reacts with a tapered upper portion 140 of the split ring 134 thus, in the position illustrated in FIG. 1, causing the split ring to be expanded by cam action, thus forcing a toothed, gripping outer portion 142 of the split ring into force transferring engagement with the casing suspension collar 74.

Figure 11:
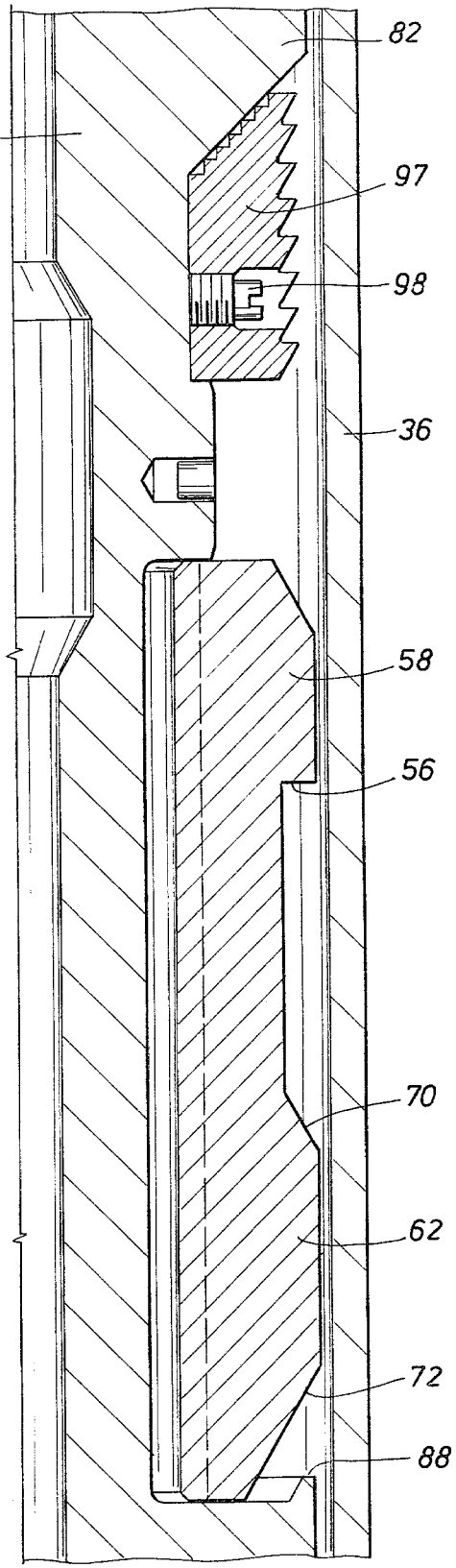
FIG. 11 is a fragmentary sectional view similar to that of FIGS. 8–10 and illustrating the positions of the locking ring and locking ring positioning element during retraction of the inner casing from the outer casing during casing pullout.

Under circumstances where it is desirable to retract one or more of the inner casing elements from the outer casings, it is desirable that the lock ring positioning element be secured at a noninterfering position. If either of the split rings 97 or 134 should be capable of radial outward movement as the casing is being retracted, it is possible for the split ring to engage a projection inside the outer casing such as might be defined at a casing joint, etc. In this case, the locking ring positioning element might move to a fouling condition between inner and outer casing structures and might in this case prevent removal of an inner casing. In order to ensure that a fouling condition of this nature does not occur, the lock ring positioning elements 97 and 134 are of spring-like nature with the natural spring tension thereof urging the split rings radially inwardly toward the respective casing suspension collar. As further shown in FIG. 1, between the annular enlarged portions 82 and 94 there is defined a recess 144 into which the split ring 97 is enabled to retract as the casing suspension collar 74 is moved upwardly, relieving application of force from the surface 108 to element 97. The spring characteristic of the split ring 97 will cause the split ring to be retracted into the recess 144, thus moving the outer periphery thereof out of possible contact with the inner wall structure of the outer conduit or any of the structural components thereof. The spring-like nature of the split ring 97 causes the split ring to be urged tightly into its receptacle, and thus it is incapable of becoming canted or otherwise positioned for inadvertent engagement with any projection defined within the outer casing. Likewise, the split ring 134 is adapted to be urged by its inherent spring-like nature into an annular recess 146, thereby retracting the outer peripheral surface portion 142 thereof out of possible contacting relation with the casing suspension collar 74 or any of the various structural components thereof. FIG. 11 illustrates the position of the split ring element 97 during retraction of the casing suspension collar 74 from the outer conduit 36.

Figure 7:
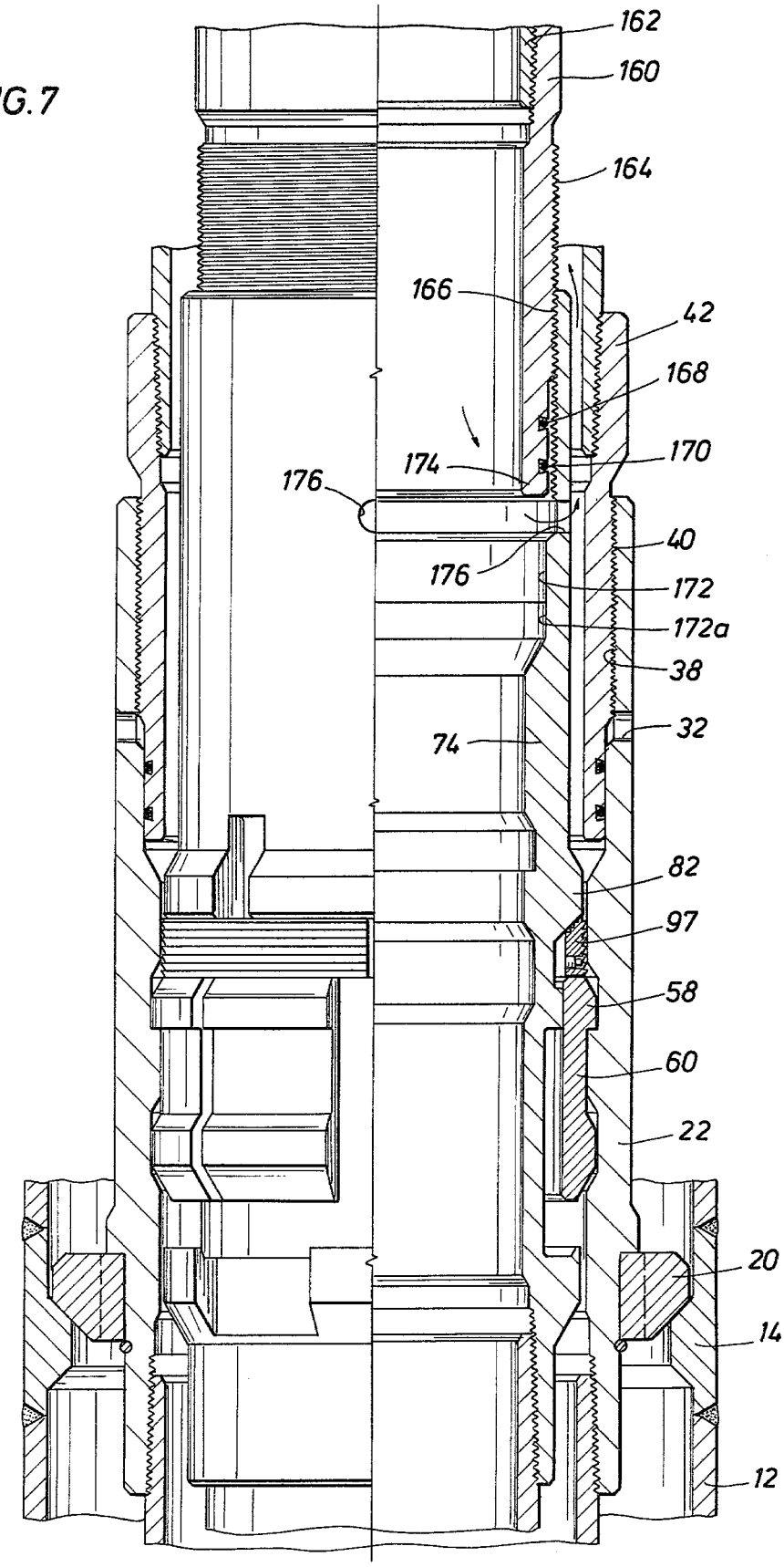
FIG. 7 is a sectional view of the well casing hanger assembly of FIGS. 1–6, and illustrating positioning of structural elements during washing operations for the purpose of clearing casing cement from the hanger assembly subsequent to casing cementing operations.

Referring now particularly to FIG. 7, subsequent to casing cementing operations, it is desirable to circulate a fluid medium between inner and outer casings at the level of the casing suspension system in order to ensure against hardening of casing cement between mechanical parts that might prevent extraction of the casing from the casing suspension system. In accordance with the present invention, the excess uncured casing cement is simply and efficiently washed away by washing fluid that is circulated downwardly through the casing, through the wash ports and then upwardly through the annulus between inner and outer casings. In the manner shown in FIG. 7, an inner casing hanger sub 160 is interconnected with the lower externally threaded portion 162 of an inner casing string. When cement washout operations are desired, the inner casing is simply counterrotated, and the elongated threaded connection between external threads 164 and internal threads 166 allow threaded structural interconnection between the casing hanger sub 160 and the casing suspension collar 74 to be effectively maintained during opening of the wash ports. With the axial upward movement of the hanger sub 160 that occurs during unthreading, the annular seals 168 and 170 are removed from sealing contact with the annular surface 172 and tapered surface **172*a* as the nose portion 174 of the hanger sub is retracted. This movement uncovers the wash ports 176**, thus allowing washing fluid to be circulated between the inner and outer casings to remove uncured casing cement that might be located in the annulus between the inner and outer casings and about the casing suspension mechanism.

Figure 12:
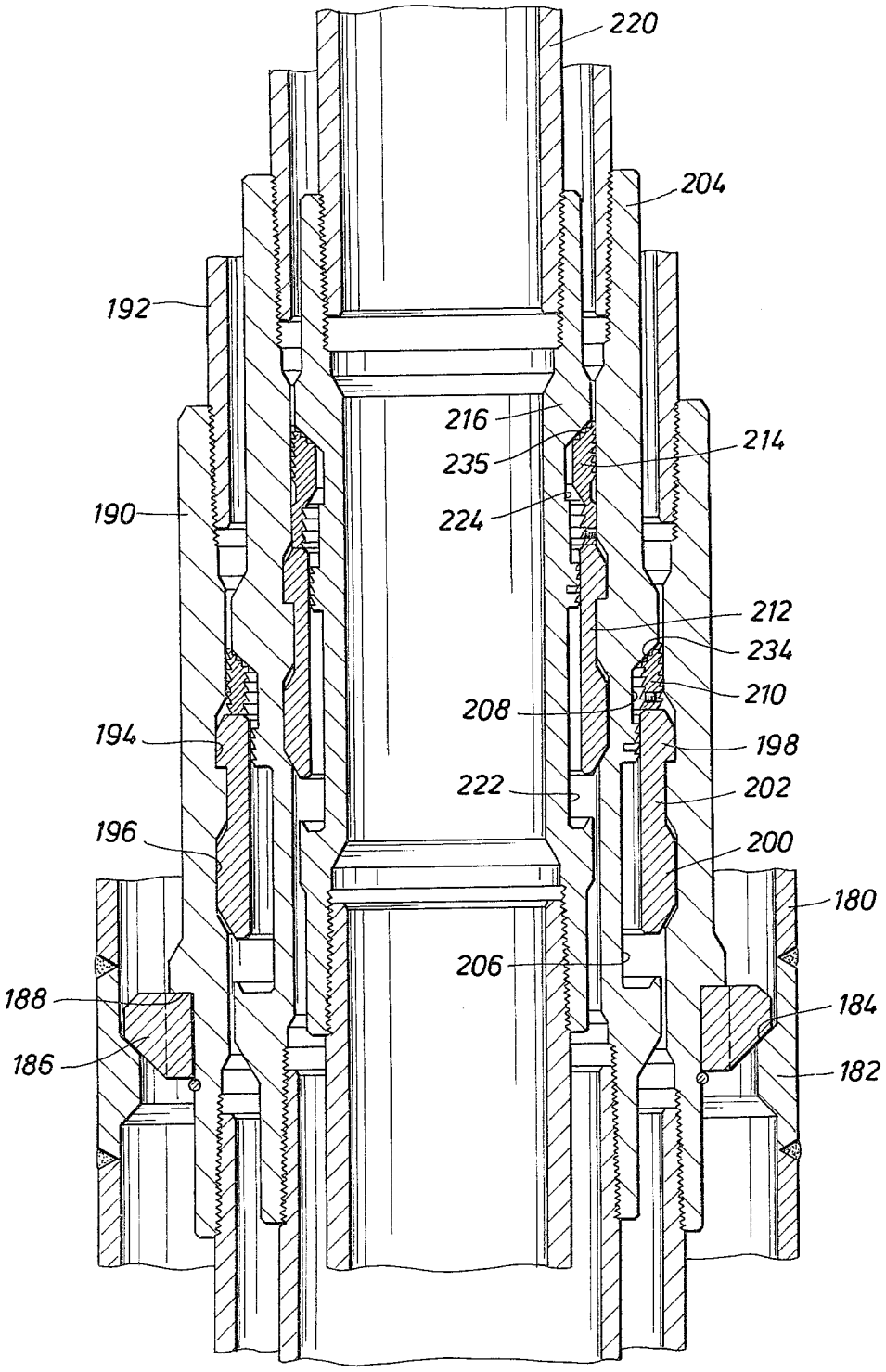
FIG. 12 is a sectional view of a casing suspension system constructed in accordance with the present invention and representing an alternative embodiment of the invention wherein a casing coupling type casing hanger system is provided with a split-nut type locking ring positioning element which is shown along with the lockin ring in the landed position thereof.

Under circumstances where it is not desired to provide was ports to achieve removal of casing cement by washing operations, the present invention may take the general form illustrated in FIG. 12 where the invention is embodied in a casing suspension system wherein upper and lower casing sections are interconnected by means of casing coupling elements. Further, as shown in FIG. 12, an enlarged view in FIGS. 13–16, lock ring positioning elements may be retained in assembly with a casing suspension collar or coupling by mechanical means other than shear pins.

Referring now particularly to FIG. 12, a conductor pipe or outer casing is provided as shown at 180 having a hanger coupling 182 interconnected therewith and defining an upwardly directed support shoulder 184 that is adapted to provide seating engagement for a hanger ring element 186 and which is in turn shouldered against a supporting shoulder 188 defined on an inner casing suspension collar 190. The collar 190 is internally threaded at the upper and lower extremities thereof, adapting the collar for threaded interconnection with a well casing 192 that extends both above and below the casing suspension system. The casing suspension collar 190 is formed internally to define an annular locking recess 194 and an annular key recess 196 that are adapted respectively to receive the locking portions 198 and key portions 200 of a locking ring 202 in similar manner as described above in connection with FIG. 1. Another inner casing hanger body or casing suspension collar 204 is positionable within casing suspension collar 190 and is formed to define external annular receptacles 206 and 208 within which the locking element 202 and a split ring type lock positioning element 210 are respectively positionable. A further inner locking element 212 and lock positioning element 214 are in turn transportable along with an inner casing suspension collar 216 that provides interconnection between upper and lower sections of an inner conduit 220. The casing suspension collar 216 defines receptacles 222 and 224 within which the locking element 212 and lock positioning element 214 are respectively received, depending upon the particular conditions involved. In each case the locking element 202 and 212 are of spring nature and define split rings with the spring tendency thereof causing the locking elements to be normally urged toward an expanded radial position as shown in FIG. 12 where the locking and key portions thereof are received within respective locking and key recesses defined in the casing suspension collars. Also in each case, the lock positioning element 210 and 214 are in the form of split rings and the spring tendency thereof urges the lock positioning elements radially inwardly toward a tightly received relation within respective ones of the recesses 208 and 224.

Referring now particularly to FIGS. 13–16, the lock ring positioning element 210 is shown to define a split ring having an internal surface portion 226 thereof that is defined by threads or by annular ridges and grooves and adapted for mating engagement with the outer surface portion of an annular enlargement 228 that defines mating threads as illustrated at 230. The outer peripheral surface portion of the lock ring positioning elements 210 and 214 define annular ridges and grooves or threads as shown at 232 in similar manner as element 97 of FIGS. 1–11 while the upper portion of the split rings 210 and 214 define tapered portions 234 and 235 that also defines annular ridges and grooves in the manner described above in connection with FIGS. 1–11. The split rings 210 and 214 are formed internally to define short axially extending recesses 236 within which is received a positioning head or projection 238 that is threadedly received within an aperture 240. In the casing where the mating ridges and grooves 226–230 are defined by threads, the split ring 210 is installed in threaded inner engagement with the external threads 230 of the enlargement 228 simply by threading the split ring onto the threads and rotating it to position the slot 236 in registry with the aperture 240. The threaded projection which may take the form of a bolt, cap screw, etc., is then inserted through the slot and is threaded into the aperture 240. The head portion of the projection prevents rotation of the the split ring and thus prevents from inadvertently becoming unthreaded during installation of an inner casing into an outer casing. The slot of the split-ring allows axial movement of the split-ring relative to the projection or anti-rotation bolt 238 during displacement of the split-ring. After the split ring has been displaced, it will note move into an interengaging relation with the anti-rotation projection as long as the inner casing remains within the outer casing. The anti-rotation projection and lock positioning element or split ring are reusable if the inner casing is extracted from the outer casing. With the anti-rotation projection removed, the lock positioning splitring is again threaded to the running position thereof on the tubular hanger body. The anti-rotation projection is then threaded into its aperture after the slot and aperture have been positioned in registry.

Figure 13:
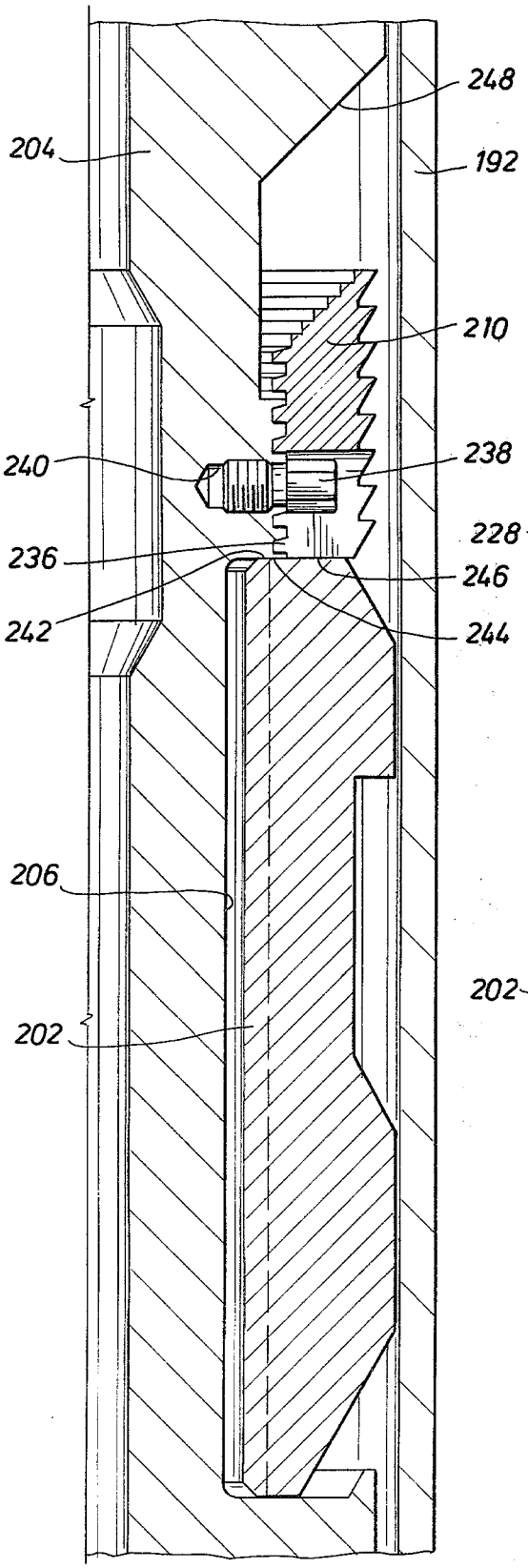
FIG. 13 is a fragmentary sectional view of the casing suspension system of FIG. 12, illustrating the locking ring and locking ring positioning element in the running positions thereof during installation of an inner casing or pipe within an outer casing.
Figure 14:
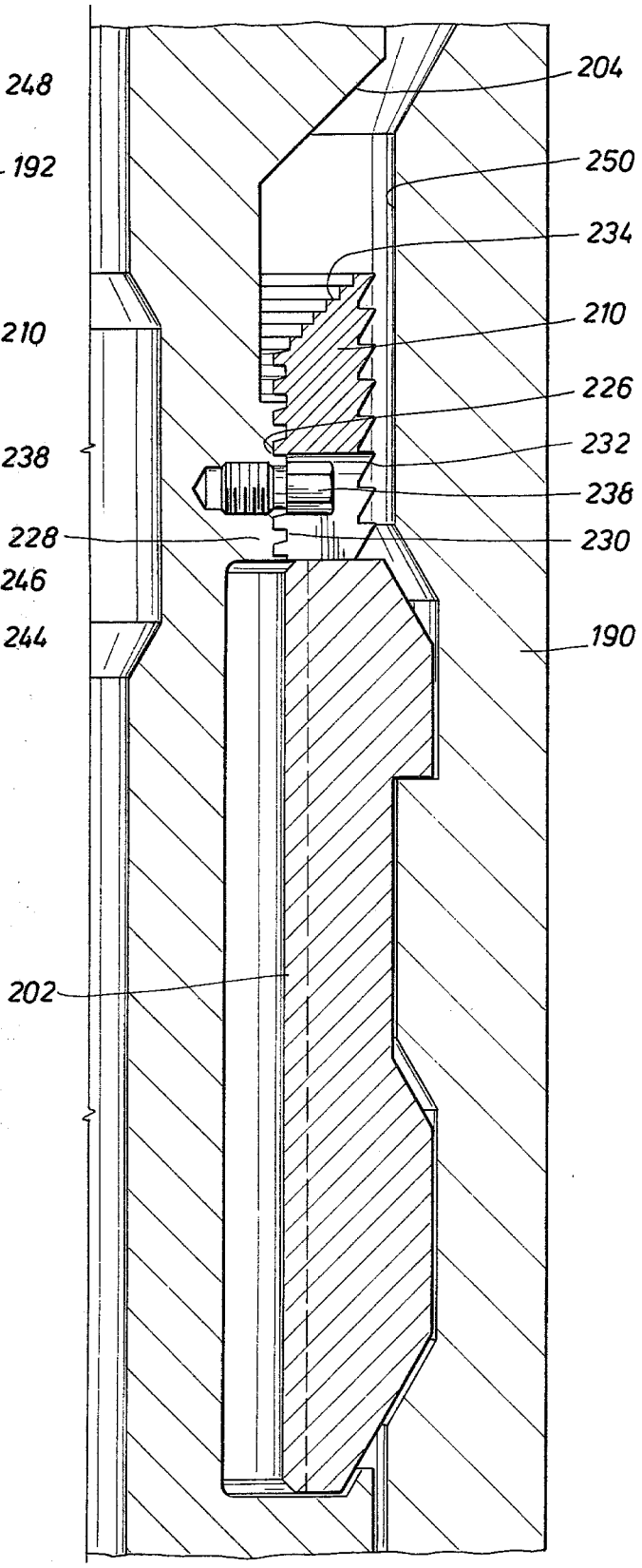
FIG. 14 is a fragmentary sectional view similar to that of FIG. 13 and illustrating the locking ring and locking ring positioning element in the partially landed position of the casing suspension system.

As shown in FIG. 13, the split ring lock positioning element 210 is in the running position thereof and the casing suspension collar 204 is being inserted into the outer conduit 192. In this case, the locking element 202 is retained in the retracted position thereof within the recess 206 and the upper extremity 242 of the locking element is in engagement with the downwardly directed shoulder 244 and with the lower surface 246 of the split ring. After the casing suspension collar 204 as moved downwardly within the outer casing 192, sufficiently to bring the locking element into registry with the locking and key recesses of the outer casing suspension collar 190, the locking element 202 will expand radially outwardly in rapid manner, causing the locking and key portions thereof to become fully received within the respective locking and key recesses. In this condition, as exemplified by FIG. 14, the casing suspension system is partially landed and the inner casing suspension collar 204 is capable of moving downwardly relative to outer casing suspension collar 190. Upon application of further downward force, the threads or annular ridges and grooves of the split ring 210 will cause radial expansion of the split ring, thus causing it to release its connection with the externally threaded or ridged portion 230 of the annular enlargement 228. As the inner casing suspension hanger 204 moves further downwardly, the locking element and the lock positioning element 210 will assume the positions illustrated in FIG. 3 with downwardly directed tapered surface 248 moving into engagement with the upper mating tapered portion 234 of the lock ring positioning element. When this occurs, the lock ring positioning element will be radially expanded by the camming activity that occurs between surface portions 234 and 248, thus causing the ribbed outer periphery 232 of the split ring to be urged into tight force transferring relation with the inner cylindrical surface 250 of the casing suspension collar 190. An outwardly directed resultant force is developed as shown by the force arrow in FIG. 15, thus transferring a portion of the load applied by the casing suspension collar 204 directly into the outer collar 190.

Figure 15:
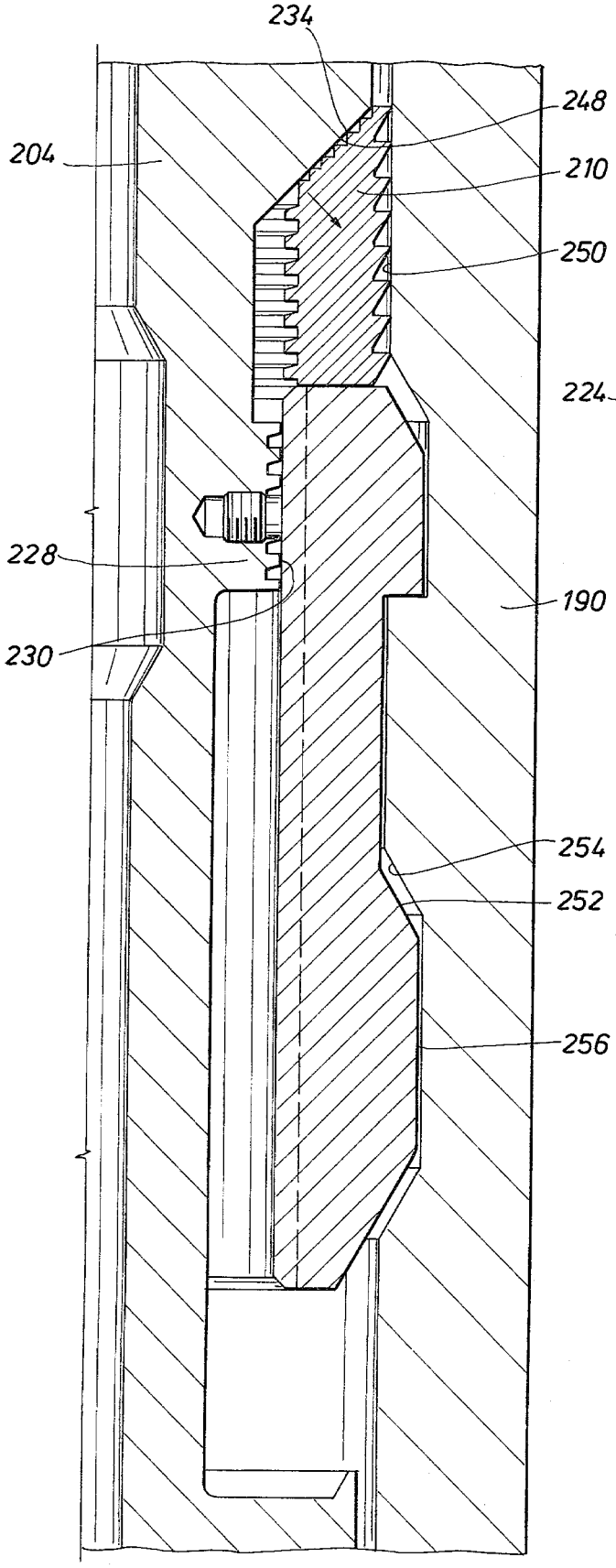
FIG. 15 is a fragmentary sectional view similar to that of FIGS. 13 and 14, illustrating the locking ring and locking ring positioning element in the fully landed positions thereof.
Figure 16:
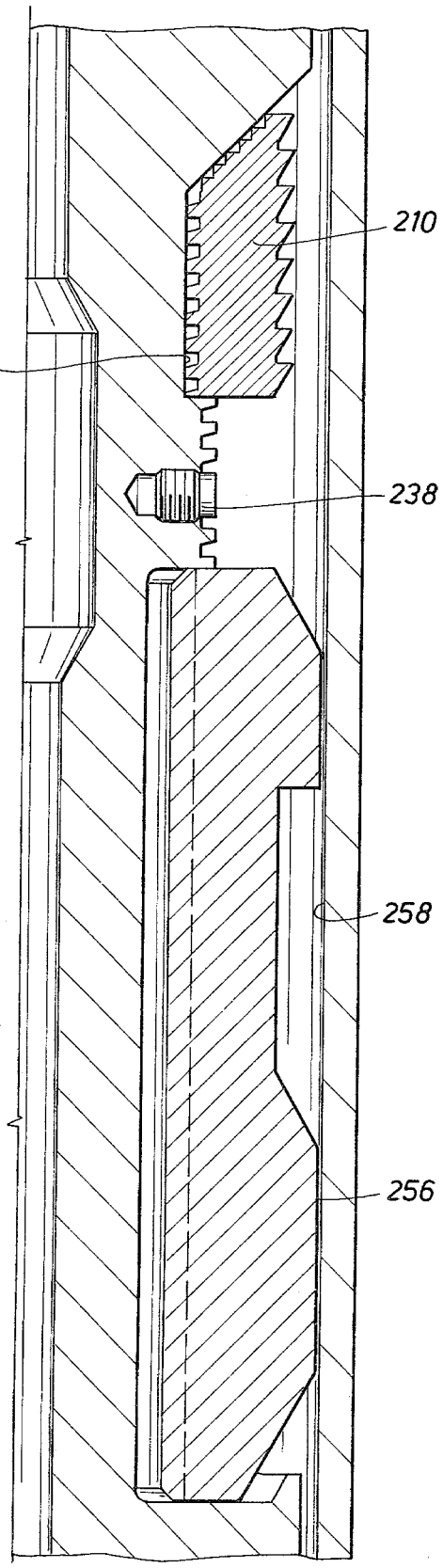
FIG. 16 is a fragmentary sectional view similar to that of FIGS. 13–15, illustrating the locking ring and locking ring positioning element in the positions thereof during retraction or pullout of the inner casing from the outer casing.

The casing suspension system will remain in the position illustrated in FIG. 15 until such time as the inner casing is retracted from the outer casing. Under this circumstance, the locking ring and lock ring positioning element will assume the positions illustrated in FIG. 16. The inherent inwardly directed spring nature of the lock ring positioning element 210 causes element 210 to be retracted tightly within its receptacle 224 as shown. In this position, the lock ring positioning element will not have any tendency whatever to engage the structural components of the outer casing during retraction thereof. The locking ring will be cammed radially inwardly to the position shown in FIG. 16 by the camming activity of the key surface 252 and key recess surface 254 until the outer surfaces 256 of the key elements are brought into engagement with the inner surface 258 of the outer conduit.

Subsequent to retraction operations, it is not necessary to completely remove the inner casing from the outer casing in order to reset the lock actuating mechanism thereof. Reseating or landing operations will occur automatically if the inner casing is simply lowered sufficiently to bring the locking element into receiving relation within the locking and key receptacles defined by the casing suspension collar.

In view of the foregoing, it is respectively submitted that the present invention is clearly capable of achieving each of the objects and features hereinabove set forth together with other objects and features that are inherent in the structure of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof. It is to be understood that all matters hereinabove set forth or shown in the accompanying drawings are to be interpreted as illustrative and not in any limiting sense.

What is claimed is:

1. A well casing suspension mechanism for suspending an inner well casing within and from an outer well casing, said casing suspension mechanism comprising:

casing suspension coupling means adapted to be connected to outer well casing extending into a well bore, said coupling means being formed internally to define an internal key recess means and internal lock recess means, said lock recess means defining upwardly directed stop shoulder surface means and said key recess means defining internal tapered surface means;

a tubular hanger body being receivable within said coupling means and being connectable to said inner well casing and defining an external lock receiving recess, an external key receiving recess and an external lock positioner recess, said tubular hanger body further defining external tapered downwardly directed shoulder means;

a split ring type locking element being movably positioned about said tubular hanger body and defining lock means adapted to be received within said lock recess means and in engagement with said stop shoulder surface means, said locking element defining key means adapted to be received within said key recess means, said key means defining external tapered surface means being engagable with said internal tapered surface means of said key recess means, said locking element being of spring nature and being normally expanded to a position locating said lock and key means respectively within said lock and key recess means, said locking element being radially contractable by externally applied mechanical force by reaction of said internal and external tapered surface means to withdraw said lock and key means from said lock and key recess means, in said radially contractable condition said locking element being at least partially received within said external lock receiving recess of said tubular hanger body; and split ring type lock positioning means being received between said tubular hanger body and said casing suspension coupling means and being of spring nature normally contacting said lock positioning element into said lock positioner recess of said tubular hanger body, said lock positioning element being positioned for contact by said tapered downwardly directed shoulder means upon downward movement of said hanger body relative thereto and being radially movable by reacting engagement thereof by said downwardly directed shoulder means against the spring tension thereof into load supporting engagement with said casing suspension coupling and into load transferring engagement with said locking element, said locking element supporting said lock positioning means during said radial movement of said lock positioning means.

2. A well casing suspension mechanism as recited in claim 1, wherein said mechanism includes:

cooperative retainer means releasably securing said lock positioning means to said tubular hanger body during installation of said tubular hanger body into said casing suspension coupling means, said cooperative retainer means releasing said lock positioning means from said tubular hanger body responsive to application of restraining force thereto by said locking element as said lock positioning means is urged downwardly by said tubular hanger body.

3. A well casing suspension mechanism as recited in claim 2, wherein said cooperative retainer means comprises:

shear pin means being fixed to said lock positioning means and being received by said tubular hanger body, upon application of sufficient restraining force thereto by said locking means said shear pin means is sheared and said lock positioning means is released from said tubular hanger body for movement relative thereto.

4. A well casing suspension mechanism as recited in claim 2, wherein said cooperative retainer means comprises:

cooperative thread means formed externally of said tubular hanger body and internally of said lock positioning means, said thread means defining a release angle determined by the desired preselected release force, upon application of restraining force to said lock positioning means by said locking element exceeding said preselected release force said lock positioning means being expanded radially and the threaded engagement thereof with said tubular hanger body being released and said lock positioning means being allowed to move axially relative to said tubular hanger body.

5. A well casing suspension mechanism as recited in claim 2, wherein said cooperative retainer means comprises:

cooperative ridges and grooves formed externally of said tubular hanger body and internally of said lock positioning means, said ridges and grooves defining cooperative release angles establishing a preselected release force, upon application of a restraining force to said lock positioning means exceeding said preselected release force, said lock positioning means being expanded radially by camming activity of said release angles and the retaining engagement of said lock positioning means to said tubular hanger body being released and said lock positioning means being allowed to move axially relative to said tubular hanger body.

6. A well casing suspension mechanism as recited in claim 1, wherein:

said casing suspension coupling means being formed to define internal load supporting surface means;

said lock positioning means being formed externally to define gripping means; and upon radial expansion of said lock positioning means said gripping means being moved into gripping relation with said internal load supporting surface means, thereby functioning in concert with said locking element to support the load of said inner well casing.

7. A well casing suspension mechanism as recited in claim 6, wherein:

said load supporting surface means of said casing suspension coupling means being of generally cylindrical configuration;

said gripping means of said lock positioning means comprises a ridged and grooved external periphery defining the outer periphery of said lock positioning means.

8. A well casing suspension mechanism as recited in claim 6, wherein:

tapered upper surface means is defined on said lock positioning means, said tapered upper surface conforming in mating relation with said external downwardly directed shoulder means and reacting with said downwardly directed shoulder means to cause radial expansion of said lock positioning means into said gripping relation with said load supporting surface means.

9. A well casing suspension mechanism as recited in claim 1, wherein said lock positioning means comprises:

upper and lower split-ring lock positioning elements positioned on either side of said lock receiving recess of said tubular hanger body, at least one of said split-ring lock positioning elements being transported and positioned by said tubular hanger body.

10. A well casing suspension mechanism as recited in claim 9, wherein:

both of said lock positioning elements are radially expanded into gripping relation with said casing suspension coupling means.

11. A well casing suspension mechanism as recited in claim 9, wherein:

one of said lock positioning elements is radially expanded into gripping relation with said casing suspension coupling means; and the other one of said lock positioning elements is radially contracted into gripping engagement with said tubular hanger body.

12. A well casing suspension mechanism as recited in claim 4, wherein:

said locking positioning means is formed to define a slot at one axial end thereof; and an anti-rotation element is interconnected with said tubular hanger body and is positioned within said slot to prevent rotation and unthreading of said lock positioning means from said tubular hanger body during installation of said inner casing.

13. A well casing suspension mechanism as recited in claim 1, wherein:

an annular locking rim is defined about said tubular hanger body, said locking rim being positionable within said locking element at the expanded position thereof to maintain said locking element at said expanded position.

* * * * *